US005620586A

United States Patent [19]

Claessens et al.

[11] Patent Number: 5,620,586

[45] Date of Patent: Apr. 15, 1997

[54] SILVER ELECTROLYSIS METHOD IN MOEBIUS CELLS

[75] Inventors: Pierre Claessens, St-Eustache; John L. Cromwell, Pincourt, both of Canada

[73] Assignee: Noranda, Inc., Toronto, Canada

[21] Appl. No.: 563,079

[22] Filed: Nov. 27, 1995

[51] Int. Cl.[6] ..... C25C 1/20

[52] U.S. Cl. ..... 205/571; 204/225; 204/259

[58] Field of Search ..... 205/571; 204/225, 204/259

[56] References Cited

U.S. PATENT DOCUMENTS

| | | | |
|---|---|---|---|
| 2,735,810 | 2/1956 | Gagliano | 205/571 |
| 4,207,153 | 6/1980 | Flood | 204/106 |
| 4,692,222 | 9/1987 | Pellegrino et al. | 204/15 |
| 5,009,755 | 4/1991 | Shor | 205/571 |
| 5,100,528 | 3/1992 | Claessens et al. | 204/212 |
| 5,135,624 | 8/1992 | Tan et al. | 205/571 |

OTHER PUBLICATIONS

*Theoretical & Applied Electrochemistry*, M.K. Thompson, 1939, MacMillan Co., 257–260. No Month Available.

Imazawa et al., Metallurgical Review of the MMIJ, vol. 1, No. 1, 1984, technical report, 150–159. No Month Available.

B.H. Morrison, Proceedings of the Extraction Metallurgy Symposium, 1985, The Institute of Mining and Metallurgy, London, 249–269. No Month Available.

*Electrochemical Engineering*, C.L. Mantell, 1960, McGraw–Hill Book Company, 166–173. No Month Available.

*Silver: Economics, Metallurgy and Use*, O.C. Johnson, 1967, Van Nostrand Co., 78–94. No Month Available.

*Copper: The Science and Technology of the Metal, its Alloys and Compounds*, Schloen et al., 1970, Hafner Publishing Co., 265–289. No Month Available.

Shibasaki et al., "Recent improvements in silver electrolysis", *Precious metal '89*, The Minerals, Metals & Material Society, 1989, 419–430. No Month Available.

Adamson R.G., *Gold Metallurgy in South Africa*, 225–229. (Date Unknown).

Richards A.E., Proceedings of a Symposium held in London in Jul. 1949, The Institution of Mining and Metallurgy, 106–109.

McMillan W.G., "A treatise on electro–metallurgy", 1923, Charles Griffin & Co. Ltd., 297–299. No Month Available.

*Primary Examiner*—Arun S. Phasge
*Assistant Examiner*—Kishor Mayekar
*Attorney, Agent, or Firm*—Fitzpatrick, Cella, Harper & Scinto

[57] ABSTRACT

The present invention is concerned with a method for electrorefining silver in a Moebius cell whereby the anode is completely dissolved and the gold mud is removed without handling of any partially dissolved anodes. The cell is conventional except that the anodes are placed in a basket made of a thermoplastic material and surrounded by a cloth, the electrical contact between the anode and the power source takes place outside the electrolyte. The bottom of the basket is provided with apertures allowing the gold mud produced to tall into the cloth until the anode is completely dissolved.

9 Claims, 4 Drawing Sheets

SILVER ELECTROLYSIS METHOD IN MOEBIUS CELLS

FIELD OF THE INVENTION

The present invention is concerned with a novel method for the refinement of silver in conventional Moebius cells.

BACKGROUND OF THE INVENTION

One of the major elements present in the slime resulting from copper electrorefining is silver. To recover that silver, the slime is treated by various methods to impure silver anodes. Such anodes are referred to in the art as "Doré" anodes. The composition of a Doré anode greatly varies depending on the source of the slime and of the purity of the original copper anodes, but the silver content is generally from about 80% up to 99%. Doré anodes may also be obtained from lead refining or the treatment of precious metal bearing scrap. Other components or elements of these anodes include copper and precious metals like gold, palladium and platinum.

Doré anodes are refined by electrolysis to produce pure silver metal at the cathode, but this refining also produces anode mud containing gold and other precious metals present in the Doré anode. The silver electrorefining operation is conventionally carried out by using either a Mocbius cell, which is described by Mantell in *Electrochemical Engineering*, 4$^{th}$ edition, McGraw Hill Book Company, New York 1960, pp. 166–173; or a Balbach-Thum cell, which is described by de Kay Thompson in *Theoretical and Applied Electrochemistry*, 3$^{rd}$ edition, The Macmillan Company, New York, 1939, pp. 257–260. Several considerations will influence the choice of either cell. The Moebius type cell is generally preferred because it requires significantly less floor space, about ⅕ of that of a Balbach-Thum cell, and less energy for a given amount of silver refined. Although the Moebius cell requires more time for removing silver and slime, it needs very little attention during normal operation, as silver crystals building up on the cathodes are scraped mechanically and fall to the bottom of the cell. The Balbach-Thum cell requires frequent manual removal of silver deposited onto the bottom of the cell, which acts as the cathode.

Other significant differences exist between Balbach-Thum cells and Moebius cells, both in the structure and in the physical requirements of the cells, as described in pages 86–87 of *Silver: Economics, Metallurgy & Use*, (A. Butts & C. D. Coxe), Van Nostrand Company Inc. In a Moebius cell, the anodes and cathodes are suspended in an alternate manner in the cell. The anodes are only partially submerged in the electrolyte which results in a substantial portion of the impure anode being left undissolved ("scrap") at the end of an electrorefining cycle, typically lasting from 24 to 48 hours. The weight of the remaining anode scrap can amount to as high as 30% of the Doré anode originally loaded in the refining cell, and therefore it must be remelted, recast and reelectrolysed, thus increasing the overall costs for obtaining pure silver. On the other hand, in Balbach-Thum cells, the cathode is at the bottom of the cell, and the anodes are deposited at the bottom basket, parallel to the cathode, the bottom of the basket being lined with a cloth to collect the gold mud. Although complete dissolution of the silver anodes appears to occur in Balbach-Thum cells, there are significant manipulations of partially corroded silver anodes for the following reason. As stated above, the anodes are deposited onto the cloth in the basket. Since the anode contains important amounts of impurities, these impurities remain in the basket as anodes dissolve to leave a residue that is referred to in the art as gold mud. After a certain time, the dissolution of silver is impaired by the increasing amount of gold mud in the cloth, and accordingly, gold mud, together with the corroded anodes present therein, must be removed from the basket and the undissolved portion of the anodes must be washed before being returned in the cell.

Both types of cells have in common that the handling of partially corroded anodes and the recovery of gold mud are time-consuming operations, and therefore, any improvement in that respect will result in lower costs for silver refiners.

U.S. Pat. No. 5,100,528 (Claessens et al.) discloses a continuous silver refining cell wherein silver anodes are deposited in a titanium anode basket that is subsequently immersed in a tank containing tile electrolyte. Another silver electrorefining cell has been developed to reduce as much as possible anode scrap, as described by Imazawa et al in "Continuous Silver Electrorefining Operation", *Metallurgical Review of the MMIJ*, 1984, Vol. 1, No. 1, pp. 150–159. In this cell, tile basket is also made of conductive titanium material to insure contact of the impure silver anode with the positive terminal of the continuous current electrical power source. This cell, as well as the cell described in U.S. Pat. No. 5,100,528, is very complex as it allows for the simultaneous continuous withdrawal of the silver crystals deposited at the cathodes. A further drawback is that they are expensive to build and may be difficult to operate.

The use of conductive baskets is also well known in the plating industry, where replenishment of ions of a metal to be plated is assured by using soluble anodes made of the same metal. In this case, solid anodes may be suspended from the top of the cell, or smaller pieces of the same anode material can be loaded in a partially submerged basket made of inert conductive material. Titanium is conventionally used as material of construction for these baskets. A disadvantage of the use of such conductive baskets in Moebius cells is that some energy is lost at the surface of the basket by the degradation reaction of $H_2O$. In addition to the undesirable consumption of energy, this reaction produces $O_2$ and $H^+$ ions, the latter increasing the acidity of the electrolyte and impairing the efficiency of the process, since metals like palladium and platinum will dissolve in an electrolyte having a lower pH, thus significantly contaminating the silver.

U.S. Pat. No. 4,692,222 describes the use of a basket made of electrically conductive material substantially inactive to the electrical process, to contain pieces of copper used as replenishment of copper ions in a plating cell. As an alternative, the electrically conductive material may be replaced with plastic, provided that the plastic baskets contain some means of making electrical contact to the pieces of copper therein, such as by way of a conductive rod extending down into the basket. In this instance, because of the presence of the electrical contact in the electrolyte through the conductive rod, the degradation reaction of water will take place, and the acidity of the electrolyte will increase.

U.S. Pat. No. 4,207,153 is concerned with an electrorefining cell that consists of bipolar electrodes having the anode side made of a basket constructed with an acid resistant metal in which fine cemented copper is added in a slurry form. Again in this case, the material of construction of the anode baskets is a metal, such as stainless steel or titanium.

In view of the above, there is therefore a great need to improve the electroefining of silver, particularly in Moebius cells. For example, it would be desirable to develop a method combining the advantages of both Moebius and Balbach-Thum cells, namely allowing the complete dissolution of silver anodes that would be fed in a continuous manner in the electrolyte while eliminating any silver anode residue from the gold mud produced therefrom, thus preventing the manipulation of partially corroded anodes. With such a method, there would no longer be a need to recycle anode scrap by melting and casting, resulting in significant savings in silver production. Further, as mentioned above, the floor space required for a Moebius cell is significantly smaller than that of a Balbach-Thum cell.

SUMMARY OF THE INVENTION

In accordance with the present invention, there is now provided a method for the continuous electrorefining of silver in a Moebius cell by allowing a complete dissolution of the silver anode without generating acid in the electrolyte. More specifically, the method comprises inserting a silver anode in a basket made of nonconductive material and surrounded by a cloth retaining the gold mud produced during electrolysis. With such a design, the cloth is not in contact with the anode, and therefore, the gold mud may be removed from the cell without the necessity of removing or handling the partially corroded anodes remaining in the basket.

In a preferred embodiment, the basket is made of a thermoplastic material resistant to the highly corrosive environment of a silver electrorefining cell. Thermoplastic materials include high and low density polyethylene, polypropylene, polycarbonate, polyurethane, polyester, TEFLON, polyvinyl chloride (PVC), chlorinated PVC and the like. Any of these materials may also be reinforced with fibers such as fiberglass. The cloth surrounding the basket may be made of material similar to that of the basket, or any other inert material capable of sustaining the corrosive environment of silver electrolyte. To ensure that no acid is generated in the electrolyte, the electrical contact between the power source and the electrode takes place above the surface of the electrolyte.

IN THE DRAWINGS

DETAILED DESCRIPTION OF THE INVENTION

In the method of the present invention, the conventional Moebius cell has been modified to replace hanging anodes with a basket having its upper edges extending above the electrolyte level in the tank, and wherein the anodes are deposited in a continuous manner. The basket comprises openings on each sidewall to allow the passage of electrolyte and is surrounded by a cloth or bag to collect the gold mud produced from the silver electrolysis. The electrical contact between the anode and the power source is made above the electrolyte level through a portion of undissolved anode or through another anode placed above the first anode. The electrical contact between the cathode and the power source is also made above the electrolyte level. Many advantages results from carrying out the present method in Moebius cells equipped with such baskets. Anodes can be fed in a continuous manner; the production of anode scrap is eliminated, and the gold mud is recovered in the cloth around the basket without the need to remove any partially corroded anode remaining in the basket. The use of a nonconductive material for the basket prevents the generation of oxygen and the production of acid caused by the degradation of $H_2O$ in the electrolyte. Experience has shown that electrorefining of silver in titanium basket causes the acidity to increase by as much as 1 to 2 g/L. An increase in acidity of the electrolyte near the anodes is detrimental as it promotes an increase in the level of palladium dissolution into the electrolyte, which results in an increase in the contamination of the pure silver metal produced at the cathode.

Sometimes, an increase in the acidity of the electrolyte can be caused by special circumstances resulting in passivation of the anodes, with simultaneous production of oxygen by decomposition of water at the anode/electrolyte interface. However, passivation was definitely not the cause of the acidity increase in the tests carried out by the present inventors with a titanium basket. From a closer examination of the phenomenon, it can be concluded that the increase in acidity observed with the titanium basket is probably caused by a parasitic water decomposition reaction at the surface of the titanium metal, instead of normal silver dissolution of the anode. The liter that some part of the current applied to the basket is diverted to the surface of the basket, instead of to the silver anode, may be explained by the presence of a poorly conductive slime layer building-up at the surface of the anode, thereby decreasing the quality of the electrical contact between the titanium basket and the silver anode.

Figure 1:
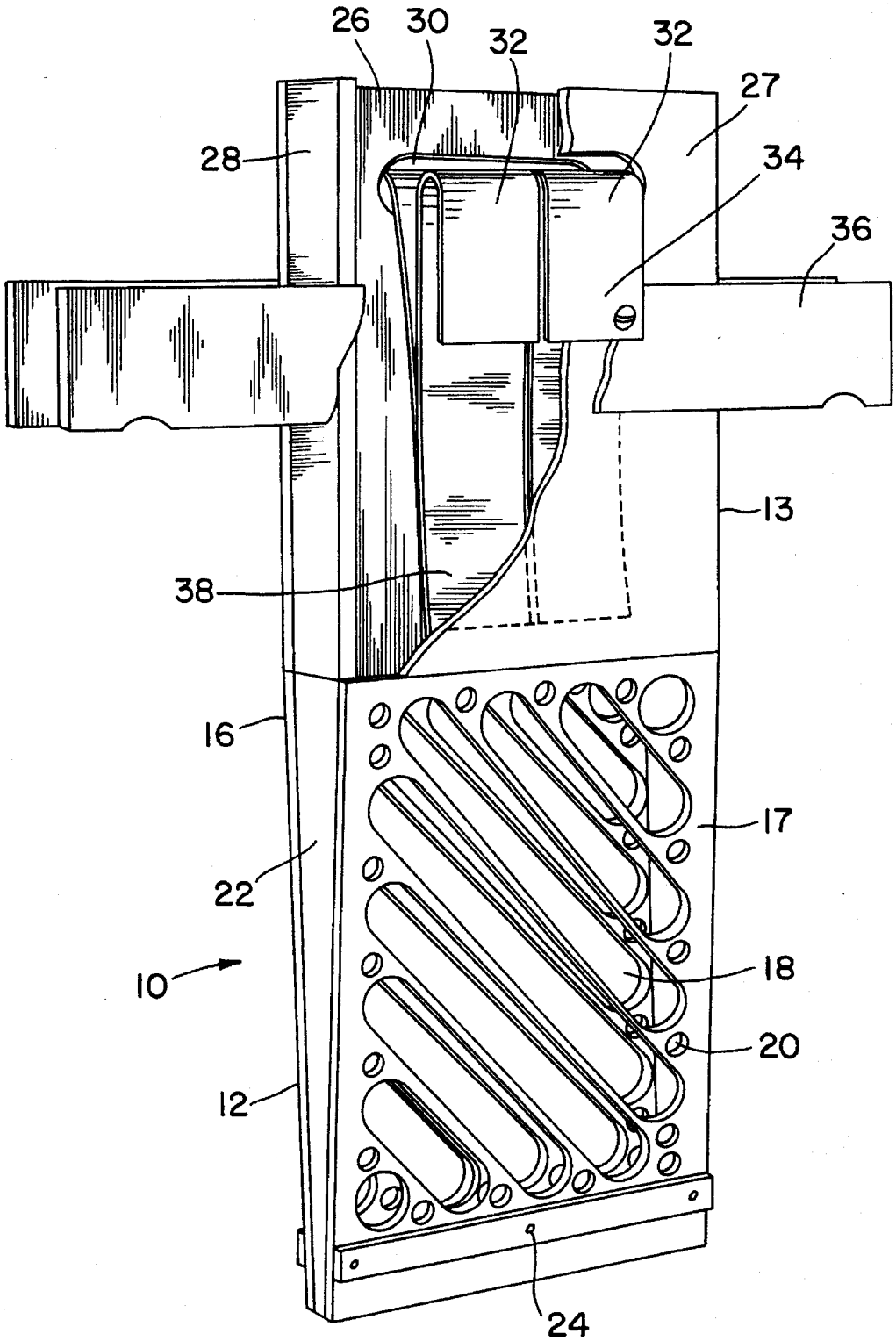
FIG. 1 illustrates a perspective view of a basket suitable for the present method.
Figure 4:
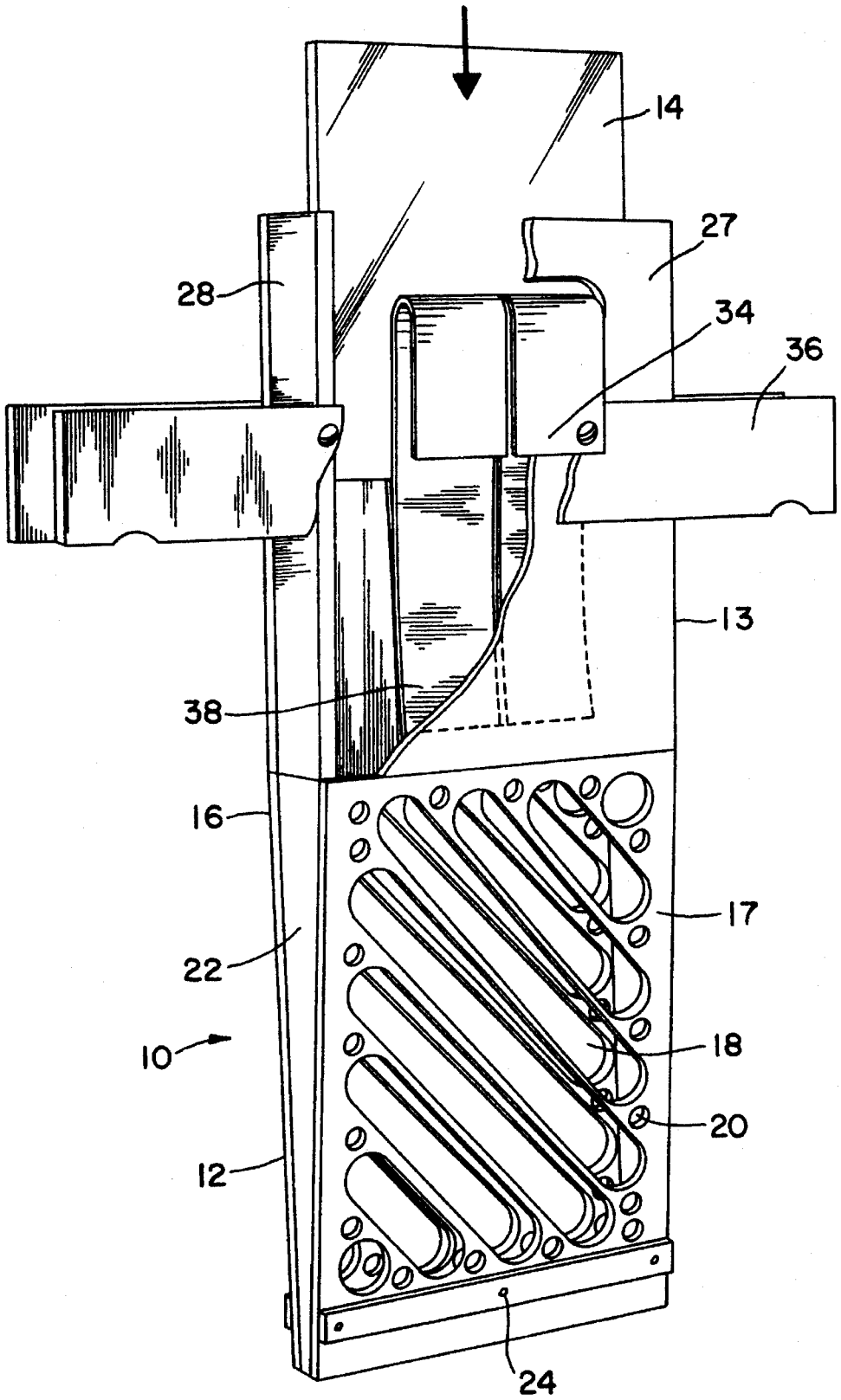
FIG. 4 is a perspective view illustrating an anode.

Referring to FIG. 1, which illustrates a preferred embodiment of the invention, basket 10 made of polycarbonate plastic, for example LEXAN manufactured and sold by General Electric, comprises compartments 12 and 13 adapted to receive an anode 14 therein (FIG. 4). Compartment 12 is made of a pair of walls 16 and 17 provided with a plurality of slots 18 and/or round openings 20, or combinations thereof, and sidewalls 22. It is preferable to avoid orienting slots 18 in a vertical position, as the solid vertical divisions could act as shields against the current, causing vertical sections of the anodes to dissolve at a reduced rate. Horizontal slots are also preferably avoided as they may mechanically prevent anodes from sliding down the basket as they progressively dissolve. In a preferred embodiment, the section of compartment 12 is tapered, that is, sidewalls 22 are wider at the top of compartment 12. The purpose of this taper is to possibly prevent two dissolving anodes to slide one over the other. The bottom of compartment 12 is open, but at least one spacer 24 is provided between walls 16 and 17 to support the anode. The large open surface area of the bottom of compartment 12 serves to eliminate any gold mud freed from the surface of the dissolving anodes.

Compartment 13 is sitting on, moulded with, or secured to the top of compartment 12, and comprises a pair of walls 26 and 27 separated by a pair of sidewalls 28 having a width corresponding to that at the top of sidewalls 22. Walls 26 and 27 also comprise a slot 30 adapted to receive at least one copper lath or strip 32 having one end 34 secured to a piece of a conductive material 36, preferably copper, which is itself secured on the external side of walls 26 and 27, the material 36 being electrically connected to the power source (not shown). The other end 38 of copper lath or strip 32 is inside compartment 13 and in contact with an anode inside compartment 13 (not shown) above the electrolyte surface.

Figure 3:
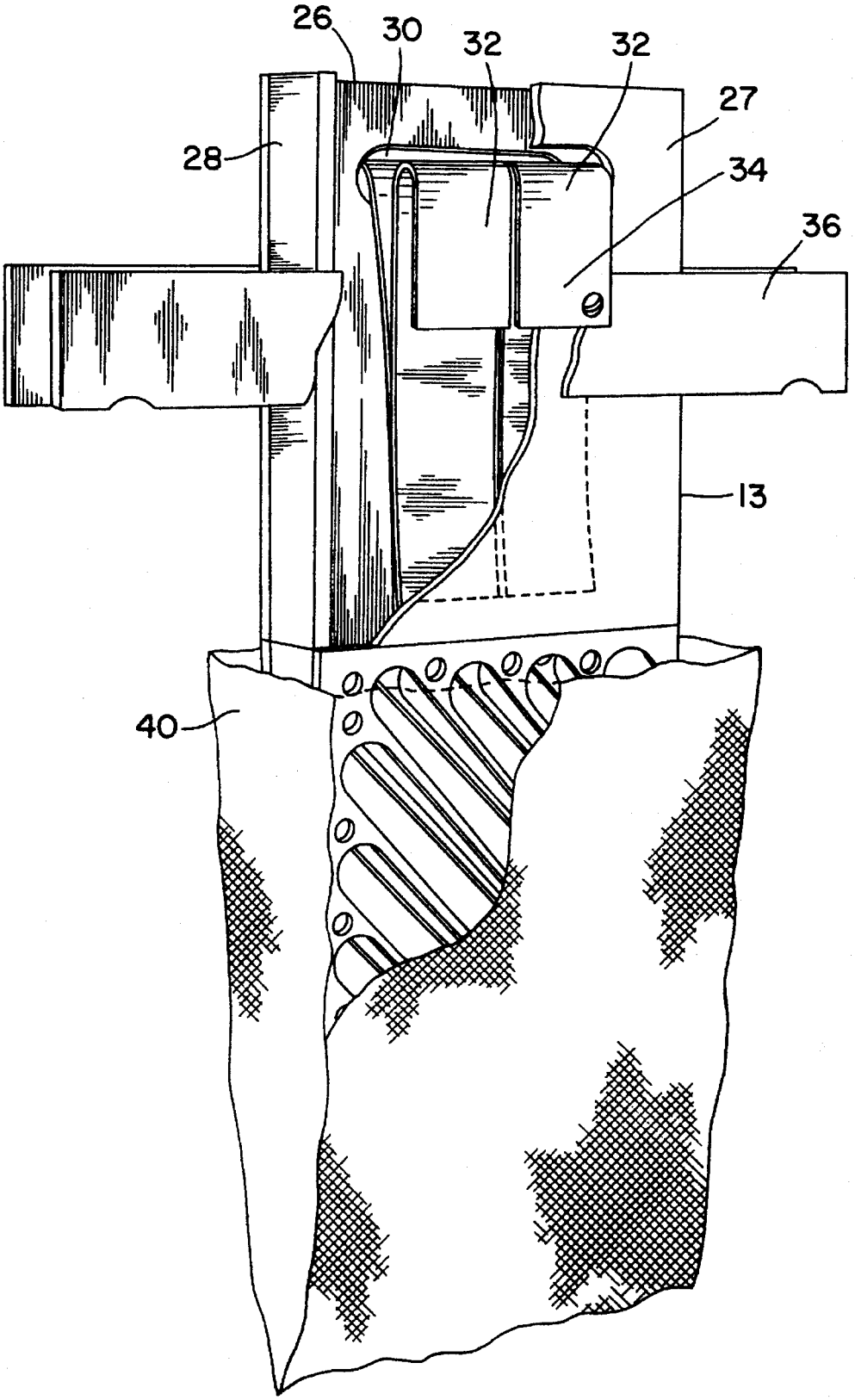
FIG. 3 illustrates a perspective view of a basket with a cloth installed therearound.

Finally, a cloth 40 is installed around the basket to retain any gold mud produced during electrolysis of the anodes (FIG. 3).

Figure 2:
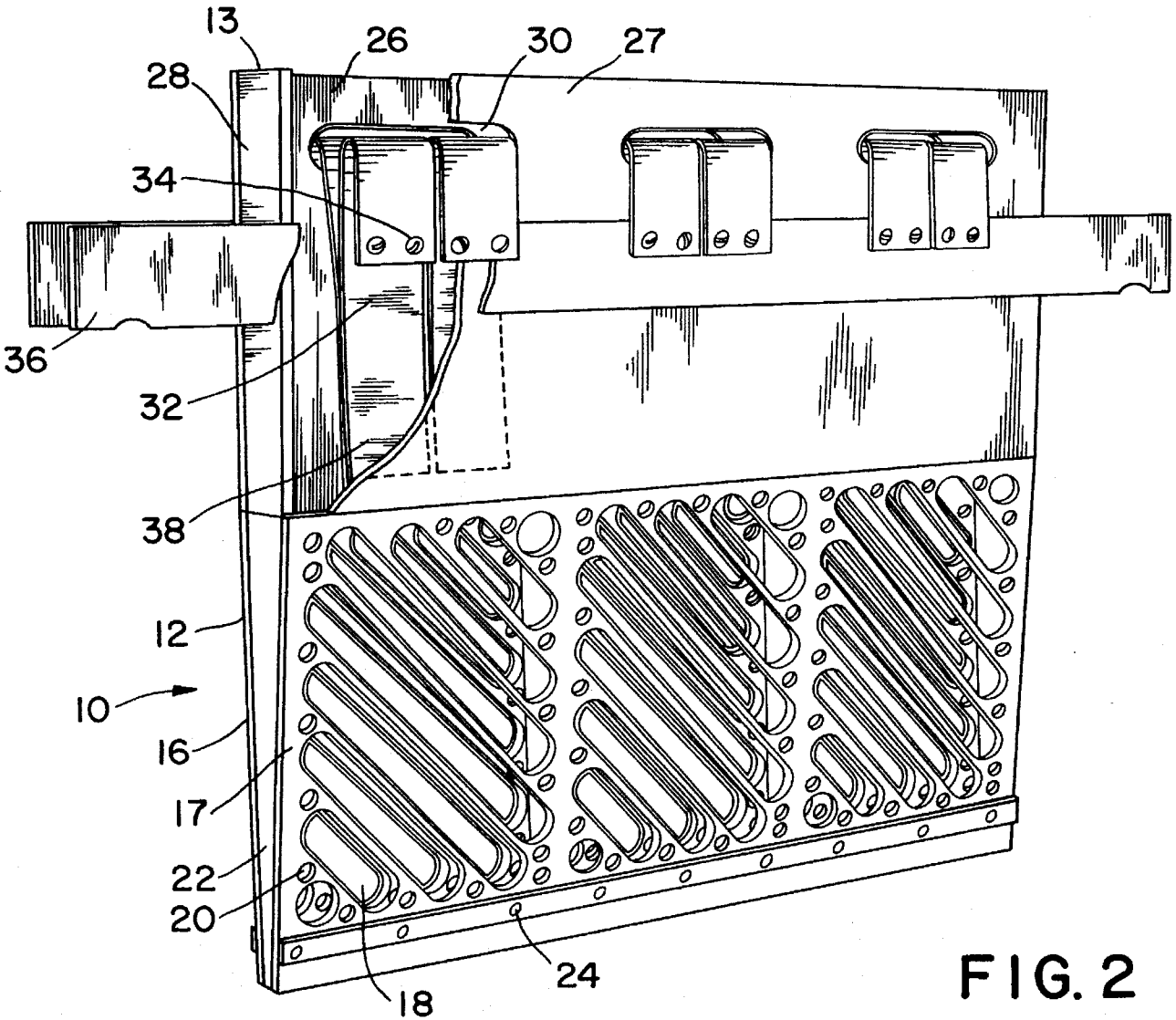
FIG. 2 illustrates a perspective view of a plurality of baskets of FIG. 1 joined.

In operation, a first anode is slid into compartment 12 through compartment 13, and a second anode is placed on top of the first anode. Compartment 12 is then surrounded with a cloth and placed in an electrolysis bath (not shown) by slowly immersing compartment 12 in the electrolyte solution. Slots 18 and/or openings 20 will allow for the free passage of ions upon application of current in the electrolyte. At no time is the electrolyte solution in contact with copper lath or strip 32, since the latter would dissolve preferentially to the silver anode, thus contaminating the electrolyte solution. Copper lath or strip 32 is then electrically connected to the positive end of a power source via conductive material 36, and a cathode, electrically connected to the negative end of the power source, is inserted in the bath (not shown). The cathode may be any cathode conventionally used in the field of silver refining, or in Moebius cells. As current is applied, the submerged anode inside the basket progressively dissolves and slides downwardly. To maintain electrical contact, a new anode is inserted on top of the one in the basket as the latter progressively falls below the electrolyte surface. The surfaces of the cathodes are scraped from time to time in the conventional manner. Operation of such experimental baskets in a commercial Moebius cell over extended periods of time has shown to be totally problem free. No anode scrap is produced, nor is the acidity of the electrolyte increased inside the cell. Further, the anode is never in contact with the gold mud, thus insuring that substantially all the silver present in the anode is dissolved and deposited at the cathode, thus completely eliminating any undesirable manipulation of partially corroded silver anode while the method is in operation. The method is stopped from time to time to collect the refined silver at the bottom of the cell. The continuity of the process is therefore easily maintained by simply feeding the top of compartment 13 with silver anodes when necessary to preserve the electrical contact. As illustrated in FIG. 2, a plurality of baskets 10 may be joined.

The electrical contact is thus made with the top of the anode and the passage current to the bottom of the anode, which is submerged, is assured without the presence any foreign conductive material. This arrangement significantly differs from that described in U.S. Pat. No. 4,692,222 mentioned above, in that the contact is made from a non-submerged or partly submerged anode to the active submerged anode and no conductive material other than the impure silver anode extends down into the basket in the electrolyte solution.

The experimental conditions for carrying the method of the present invention are those used conventionally in any Moebius cells. For example, in the case of silver, the conditions are as follows:

temperature of the electrolyte: 30°–50° C.

voltage: 3–5 volts current density: 300–900 Amps/$m^2$ cathode material: titanium, stainless steel or silver acidity level: 0.1 to 10 g/L of nitric acid electrolyte: 50–150 g/L $Ag^+$ & 10–50 g/L $Cu^{++}$ (both as nitrates)

These above parameters are provided to illustrate the preferred experimental conditions, and should not be construed as limiting the scope of the invention.

The appropriate shape and dimensions of a basket are to be adjusted to the size and shape of the anodes to be refined. Any one of ordinary skill in the art can make those adjustments. Similarly, the method of assembly of the various parts of the basket may vary from that used in the experimental basket, wherein the parts have been fastened with screws, the latter being isolated from the electrolyte. Gluing of the various parts or moulding of the basket as one piece can also be envisaged. Finally, the material of construction of the basket, its geometry, and the method of construction and assembly can differ from the example shown, as long as the basket is constructed of nonconductive material presenting an appropriate resistance to the chemical environment prevailing in the silver electrorefining cell. Further, it is imperative that the electrical contact between the anode and the power source be made outside the electrolytic bath and that the cloth surrounding the basket is not in contact with the anode.

While the invention has been described in connection with specific embodiments thereof, it will be understood that it is capable of further modifications and this application is intended to cover may variations, uses or adaptations of the invention following, in general, the principles of the invention and including such departures from the present disclosure as come within known or customary practice within the art to which the invention pertains, and as may be applied to the essential features hereinbefore set forth, and as follows in the scope of the appended claims.

What is claimed is:

1. A method for the continuous electrorefining of silver in a conventional Moebius cell comprising the steps of:

providing a Moebius cell;

inserting an anode of silver in a basket made of nonconductive material and comprising a plurality of apertures in side walls and bottom thereof, the basket being provided with conductive means secured thereon and connected to a power source at one end and in electrical contact with the anode at the other end thereof;

surrounding the basket with a cloth to retain gold mud remaining from electrolysis of the anode, the cloth allowing silver ions dissolved during the electrolysis to flow freely therethrough;

immersing the basket in an electrolyte and electrorefining in the Moebius cell by applying current to dissolve the anode and induce silver deposition on a cathode, with the proviso that the conductive means are in electrical contact with the anode above a surface of the electrolyte and the conductive means are not in contact with the electrolyte;

continuously inserting a new silver anode in the basket over a dissolving anode while it is still immersed to maintain the dissolving anode, the newly inserted anode and the conductive means; and recovering silver deposited on the cathode.

2. A method according to claim 1 wherein the conductive means comprises at least one copper strip.

3. A method according to claim 2 wherein the conductive means comprises a pair of copper strips each secured to a piece of copper that is itself secured to opposite side walls of the basket, the piece of copper being in electrical contact with the power source.

4. A method according to claim 1 wherein the nonconductive material comprises a thermoplastic material.

5. A method according to claim 4 wherein the thermoplastic material is selected from the group consisting of high and low density polyethylene, polypropylene, polycarbonate, polyurethane, polyester, polytetrafluoroethylene (TEFLON), polyvinyl chloride and chlorinated polyvinyl chloride.

6. A method according to claim 1 wherein the cloth comprises a thermoplastic material.

7. A method according to claim 6 wherein the thermoplastic material is selected from the group consisting of high and low density polyethylene, polypropylene, polyurethane, polyester and polytetrafluoroethylene (TEFLON).

8. A method according to claim 1 further comprising the step of periodically scraping the cathode to remove the silver deposited thereon.

9. A method for the continuous electrorefining of silver in a conventional Moebius cell comprising the steps of:

providing a Moebius cell;

inserting a silver anode in a basket made of nonconductive material and comprising a plurality of apertures in side walls and bottom thereof, the basket being provided with copper strips secured on two opposite side walls and connected to a power source at one end and in electrical contact with the anode at the other end, the copper strips being adapted to allow the anode to be continuously slid therebetween in the basket;

surrounding the basket with a cloth to retain gold mud remaining from electrolysis of the anode, the cloth allowing silver ions dissolved during the electrolysis to flow freely therethrough;

immersing the basket in an electrolyte and electrorefining in the Moebius cell by applying current to dissolve the silver anode and induce silver deposition on a cathode, with the proviso that the electrical contact between the copper strips and the anode is above a surface of the electrolyte and the copper strips are not in contact with the electrolyte;

continuously inserting a new silver anode in the basket over a dissolving anode while it is still immersed to maintain the electrical contact between the newly inserted anode, the dissolving anode and the copper strips; and recovering silver deposited on the cathode.

* * * * *